US008152398B2

(12) United States Patent
Kim et al.

(10) Patent No.: US 8,152,398 B2
(45) Date of Patent: Apr. 10, 2012

(54) ONE-HAND LIPSTICK CONTAINER

(76) Inventors: Tae Jin Kim, Middletown, CT (US); Tae Yeon Kim, Alpine, NJ (US)

( * ) Notice: Subject to any disclaimer, the term of this patent is extended or adjusted under 35 U.S.C. 154(b) by 389 days.

(21) Appl. No.: 12/562,981

(22) Filed: Sep. 18, 2009

(65) Prior Publication Data

US 2011/0070012 A1 Mar. 24, 2011

(51) Int. Cl.
*B43K 7/12* (2006.01)

(52) U.S. Cl. ..... 401/108; 401/60

(58) Field of Classification Search ..... 401/59, 401/60, 107, 108
See application file for complete search history.

(56) References Cited

U.S. PATENT DOCUMENTS 2,386,417 A 10/1945 Apfelbaum
2,486,073 A 10/1949 Dann
2,513,830 A 7/1950 Voegeli
2,644,577 A 7/1953 Orenick
3,612,072 A 10/1971 Fukui
3,617,138 A 11/1971 Fukui
4,973,178 A 11/1990 Kakuta et al.
5,171,096 A 12/1992 Perrotti
5,423,622 A * 6/1995 Perrotti ..... 401/59
5,890,826 A * 4/1999 Kim ..... 401/60
5,904,431 A 5/1999 Terruzzi
5,979,468 A 11/1999 Blake, III
6,056,465 A 5/2000 Kuo
6,588,959 B1 * 7/2003 Kuo ..... 401/108

* cited by examiner

*Primary Examiner* — Huyen Le
(74) *Attorney, Agent, or Firm* — LRK Patent Law Firm

(57) ABSTRACT

The present invention relates to a one-hand lipstick container, which includes: a container main body having a cylinder stood at the center of a body and a center through-hole formed through the center of the cylinder; a container cover that is rotatably connected to the upper portion of the container main body and has an open inlet formed through the upper surface; a cover holder that is combined by a spiral with the outer side of the cylinder of the container main body in the container cover and vertically ascends/descends by rotational force of the container cover; a door that is hinged to the cover holder to open/close the upper portion of the cover holder, opens a passage when the cover holder descends, and closes the passage when the cover holder ascends; a lipstick housing that is combined by a spiral with the inner side of the center through-hole of the container main body in the cover holder, vertically ascends/descends by rotational force of the cover holder, and ascends/descends in the opposite directions to the ascent/descent directions of the cover holder; and an anti-rotation means that transmits the rotational force of the cover holder to the lipstick housing and vertically guides the lipstick housing to ascend/descend in the opposite directions to the ascent/descent directions of the cover holder.

26 Claims, 18 Drawing Sheets

ONE-HAND LIPSTICK CONTAINER

BACKGROUND OF THE INVENTION

1. Field of the Invention

The present invention relates to a lipstick container, in detail, a one-hand lipstick container that can be used by one hand.

2. Description of Related Art

In general, lipsticks are necessities that most women carry. Although most women put on a lipstick in the house to go outside, they put on a lipstick at the outside also in many cases. Therefore, lipsticks should be easy to carry and use.

Containers for the lipsticks are formed such that a container main body and a container cover are separated, such that users had to use the lipstick with one hand while holding the container cover with other hand.

The structure of existing lipstick containers known in the art is described below.

Lipstick containers are composed of a cylinder with a vertical groove standing in a container main body, a lipstick holder inserted in the container main body, an outer container surrounding the outer side of the cylinder in the container main body, and a cover have been widely known.

The lipstick containers in the relate art have the advantage of being beautiful because there is no protrusion in the containers receiving a lipstick, and giving an elegant impression because of using rotational motion, and reducing manufacturing cost and time because the number of parts is small; however, users have to use both hands to open the case and turn the lower portion of the containers.

Further, the lipstick containers in the related art have a problem in that the lipstick is mashed and cannot be used, when the cover is closed, with the lipstick not fully inserted in the container.

Researches for developing a lipstick container that can be used by one hand have been conducted to increase portability and convenience of the lipstick container.

As a related art having the above object, there is a lipstick container that is operated by rotating the container main body, without using a cap, which is as follows.

First, a lipstick container including a plate covering the upper portion of the container and a device opening the plate has been proposed (U.S. Pat. No. 6,056,465). However, the above relate art has a problem in that it is not good in appearance because the plate remains on the outer side of the container when the plate opens an opening.

Further, although other technologies for inserting plates in containers have been know in the related art, there are problems in that the external appearance is deteriorated by a portion of a plate protruding outside (U.S. Pat. Nos. 5,423,622, 2,386,417, 5,979,468, 2,486,073, 3,617,138, and 3,612,072), a plate is made of a flexible material, such that stability is reduced (U.S. Pat. Nos. 2,644,577, 5,890,826, and 5,904,431), it is difficult to produce and assemble in large quantities due to too many parts, or there is high probability that defective products will be made in assemblage (U.S. Pat. No. 5,171,096).

Further, a technology that uses a protrusion for operation, such as a handle, outside the container main body (U.S. Pat. Nos. 2,513,830 and 4,973,178). Since these technologies in the related art use new methods for users, not the existing methods, there is a problem in that these may repel consumers or give them inconvenience.

SUMMARY OF THE INVENTION

In order to overcome the above problems, it is an object of the present invention to provide a one-hand lipstick container that can by easily operated and used by one hand.

It is another object of the present invention to provide a one-hand lipstick container that can be designed to have an elegant external appearance by assembling all the part in a container cover and a container main body such that the parts are not exposed to the outside.

It is another object of the present invention to provide a one-hand lipstick container that can be used by rotating the container main body, similar to existing lipstick containers.

It is another object of the present invention to provide a one-hand lipstick container in which the height of the container main body is optimized such that a user can take all action with the lipstick container in one hand.

A one-hand lipstick container for accomplishing the objects of the present invention includes: a container main body having a cylinder stood at the center of a body and a center through-hole connected to the bottom of the body through the center of the cylinder; a container cover that is rotatably connected to the upper portion of the container main body and has an open inlet formed through the upper surface; a cover holder that is combined by a spiral with the outer side of the cylinder of the container main body in the container cover and vertically ascends/descends by rotational force of the container cover; a door that is hinged to the cover holder to open/close the upper portion of the cover holder, opens a passage when the cover holder descends, and closes the passage when the cover holder ascends; a lipstick housing that is combined by a spiral with the inner side of the center through-hole of the container main body in the cover holder, vertically ascends/descends by rotational force of the cover holder, and ascends/descends in the opposite directions to the ascent/descent directions of the cover holder; and an anti-rotation means that transmits the rotational force of the cover holder to the lipstick housing and vertically guides the lipstick housing to ascend/descend in the opposite directions to the ascent/descent directions of the cover holder.

In this configuration, the center through-hole of the container main body is formed of an integral through-hole having the same inner diameter at the cylinder and at the body and an inner circumferential-spiral guide groove is formed on the inner side of the center through-hole.

Further, the lipstick housing ascending/descending with a lipstick is disposed in the center through-hole, and the lipstick housing has a cylindrical housing body and guide protrusions that are fitted in the inner circumferential-spiral guide groove are formed on the sides of the housing body.

Further, the anti-rotation means that prevents the lipstick housing from rotating with the center through-hole and allows the lipstick housing to rotate with the container cover is disposed between the lipstick housing and the center through-hole, and the anti-rotation means is formed of a pipe body and has a fixed end that is formed at the upper end of the pipe body and fitted in the cover holder to receive rotational force, and slide grooves that are vertically formed on the sides of the pipe body such that the guide protrusions formed on the lipstick housing are vertically guided through the slide grooves.

Further, the center-through hole of the container main body is formed of a two-coupled through-hole at the upper and lower portions, which has a large inner diameter at the cylinder and a small inner diameter at the body, the inner circumferential-spiral guide groove is formed on the inner side of the lower portion of the center through-hole of the body.

Further, the lipstick housing ascending/descending with a lipstick is disposed in the center through-hole, and the lipstick housing has the cylindrical housing body that is inserted in the upper portion of the center through-hole corresponding to the cylinder a slide column that extends from the bottom of the housing body and is fitted in the lower portion of the center through-hole corresponding to the body, and guide protrusions that are formed around the edge of the end of the slide column and are fitted in the inner circumferential-spiral guide groove.

Further, the anti-rotation means that prevents the lipstick housing from rotating with the center through-hole and allows the lipstick housing to rotate with the container cover is disposed around the upper end of the lipstick housing.

Further, the anti-rotation means includes side protrusions protruding from the edge of the upper end of the pipe body of the lipstick housing and protrusion guide grooves, in which the slide protrusions are fitted and vertically guided, formed on the inner side of the cover holder.

Further, the anti-rotation means allows the lipstick housing to vertically move and prevent the lipstick housing from slipping in the rotational direction by having a surface contacting with the inner side of the cover holder on the upper surface of the lipstick housing, or a protrusion fitted in the cover holder.

Further, the outer circumferential-spiral guide groove spiraling opposite to the direction of the screw on the inner side of the container main body is formed on the outer side of the cylinder.

Further, the pitch of an outer circumferential-spiral guide groove formed on the outer side of the cylinder of the container main body is not uniform.

Further, the cover holder and the door are connected by soft or thin plastic.

Further, the cover holder and the door are formed by double injection molding.

Further, a protrusion having the same shape as the shape of the inlet of the container cover is formed on the upper surface of the door.

Further, the door is separated into one or more sections and the separate doors are connected to the sides of a cover holder to simultaneously open or cover the inlet of the container cover.

Further, an outer circumference rotational-combination protrusion is formed on the outer side of the cylinder of the container main body and a spiral guide groove in which the guide protrusions are spirally fitted is formed on the inner side of the cover holder.

Further, the height of the container main body and the container cover is about the same or the height of the container main body is slightly larger.

Further, the outer shape of the container main body and the container cover is formed by N straight or curved surfaces, N is a number from 3 to the infinity, and the shape corresponding to the infinity is a circle.

Further, a door guide groove that guides the upper end of the door when the door is opened is formed on the inner side of the container cover.

Further, the shape of the inlet at the upper portion of the container cover is different from the cross-sectional shape of the lipstick.

Further, the upper surface of the door is curved.

The present invention having the configurations described above makes it possible to use the lipstick container with one hand, such that the use is simple and a good appearance is provided.

Further, according to the present invention, since all the parts are assembled in the container cover and the container main body and the parts are not exposed to the outside, the external appearance of the lipstick container can be elegantly designed. In addition, since the lipstick container is used by rotating the container main body, similar to existing lipstick containers, users can familiarly use it, without strangeness.

Further, according to the present invention, by optimizing the height of the container main body such that a user can take all action with the lipstick container in one hand, it is possible easily rotate the container cover with fingers while gripping the container main body with the palm, such that the use is convenient.

Further, the container main body and the container cover of the lipstick container can be made of high-strength synthetic resin, or metal or ceramic, and when the are made of metal, such as aluminum, it is possible to improve the quality of a product due to the peculiar luster and the feel of metal and decrease the thickness of a product, such that it is possible to decrease the entire size of the product, which contributes to refine the image of the product.

DETAILED DESCRIPTION OF THE INVENTION

Hereinafter, a preferred embodiment of the present invention is described in detail with reference to the accompanying drawings.

Figure 1:
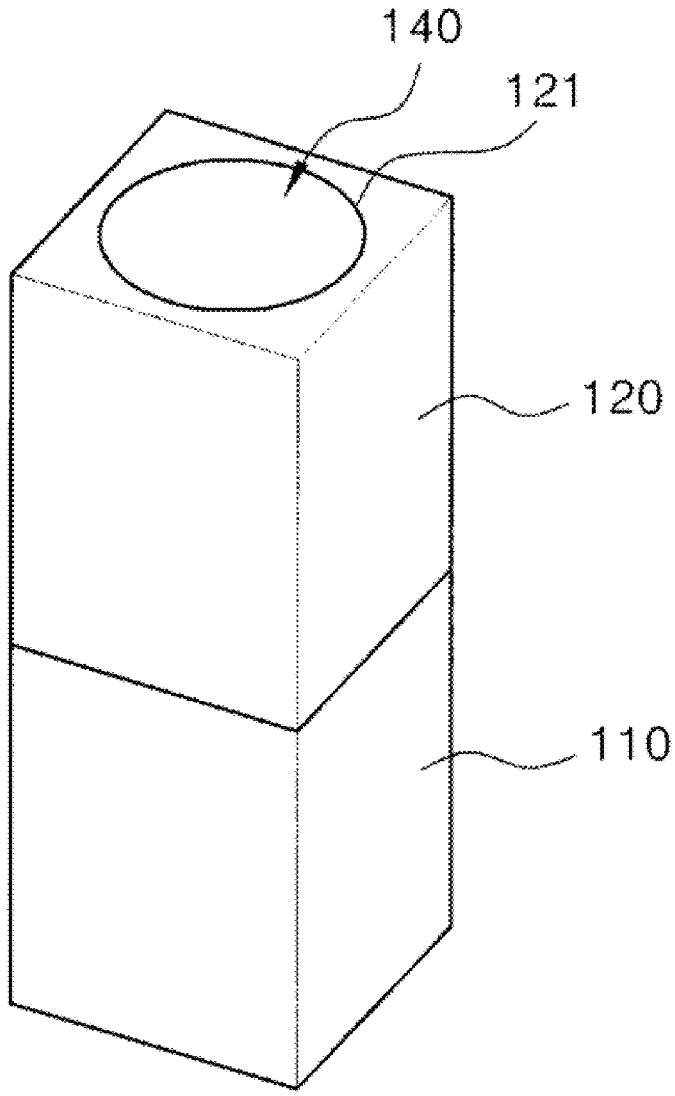
FIG. 1 is a perspective view of a one-hand lipstick container according to an embodiment of the present invention.
Figure 2:
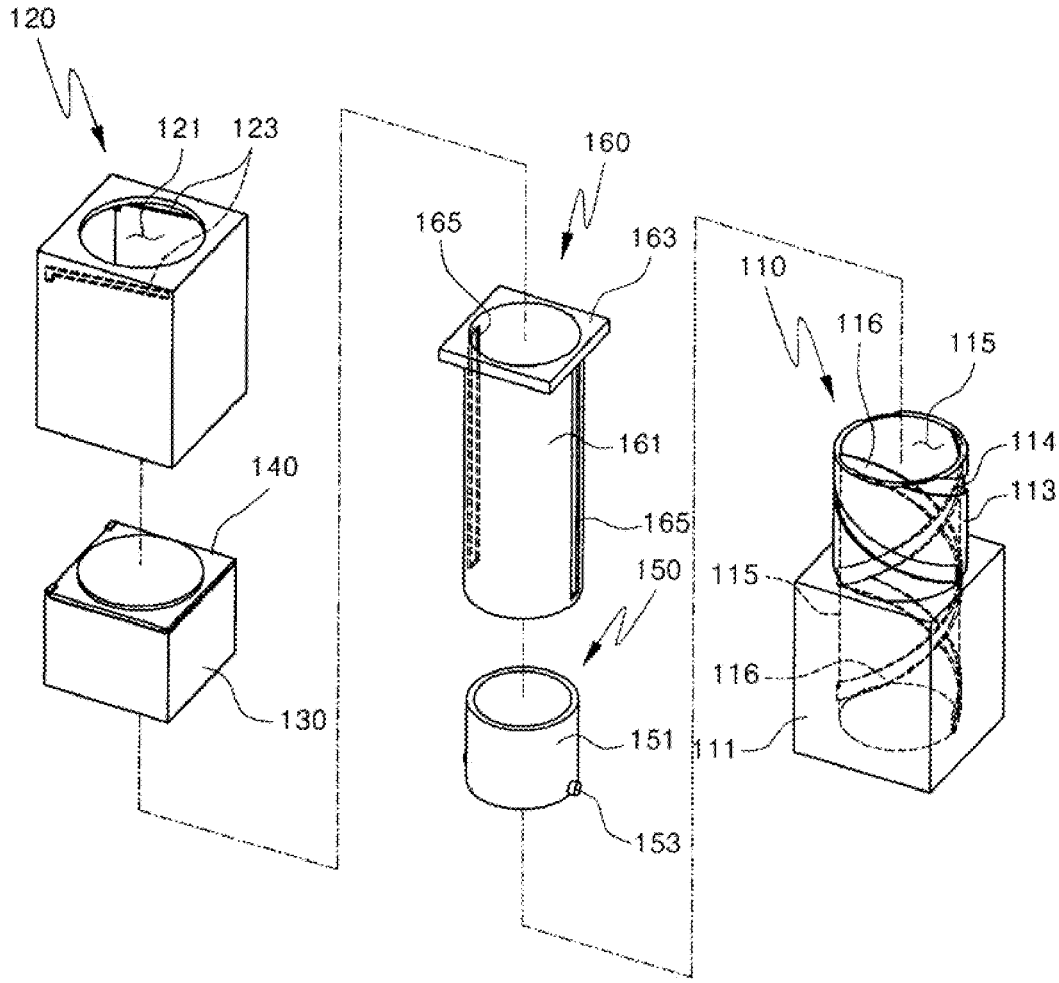
FIG. 2 is an exploded perspective view of the one-hand lipstick container according to an embodiment of the present invention.
Figure 3:
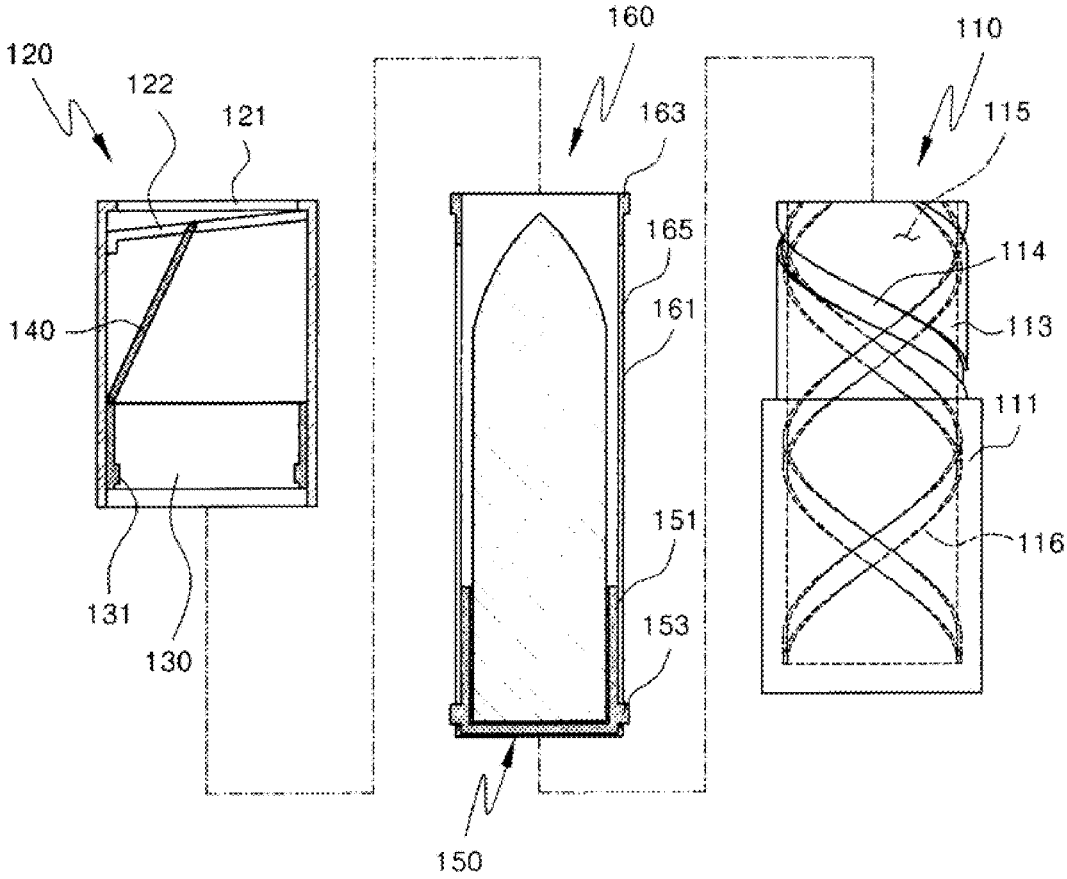
FIG. 3 is an exploded cross-sectional view of the one-hand lipstick container according to an embodiment of the present invention.
Figure 4:
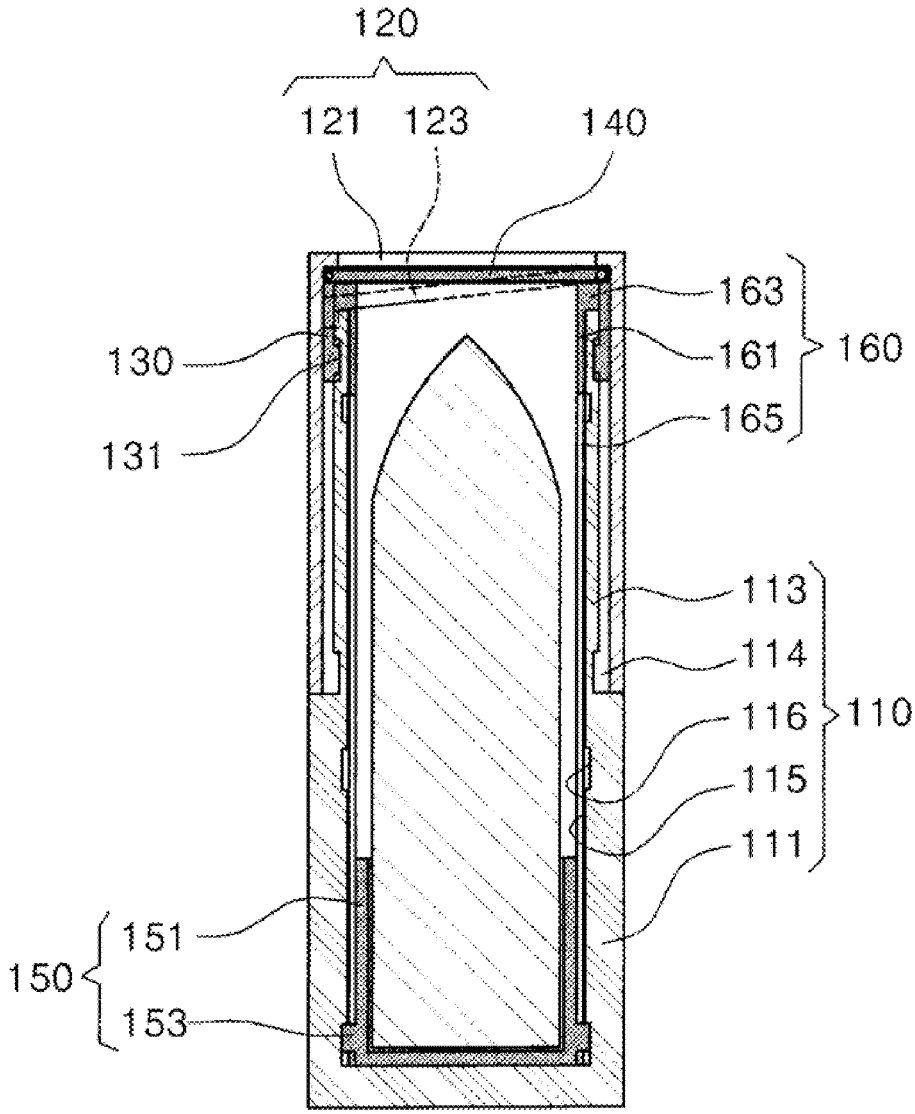
FIG. 4 is an assembly cross-sectional view of the one-hand lipstick container before it is used.
Figure 5:
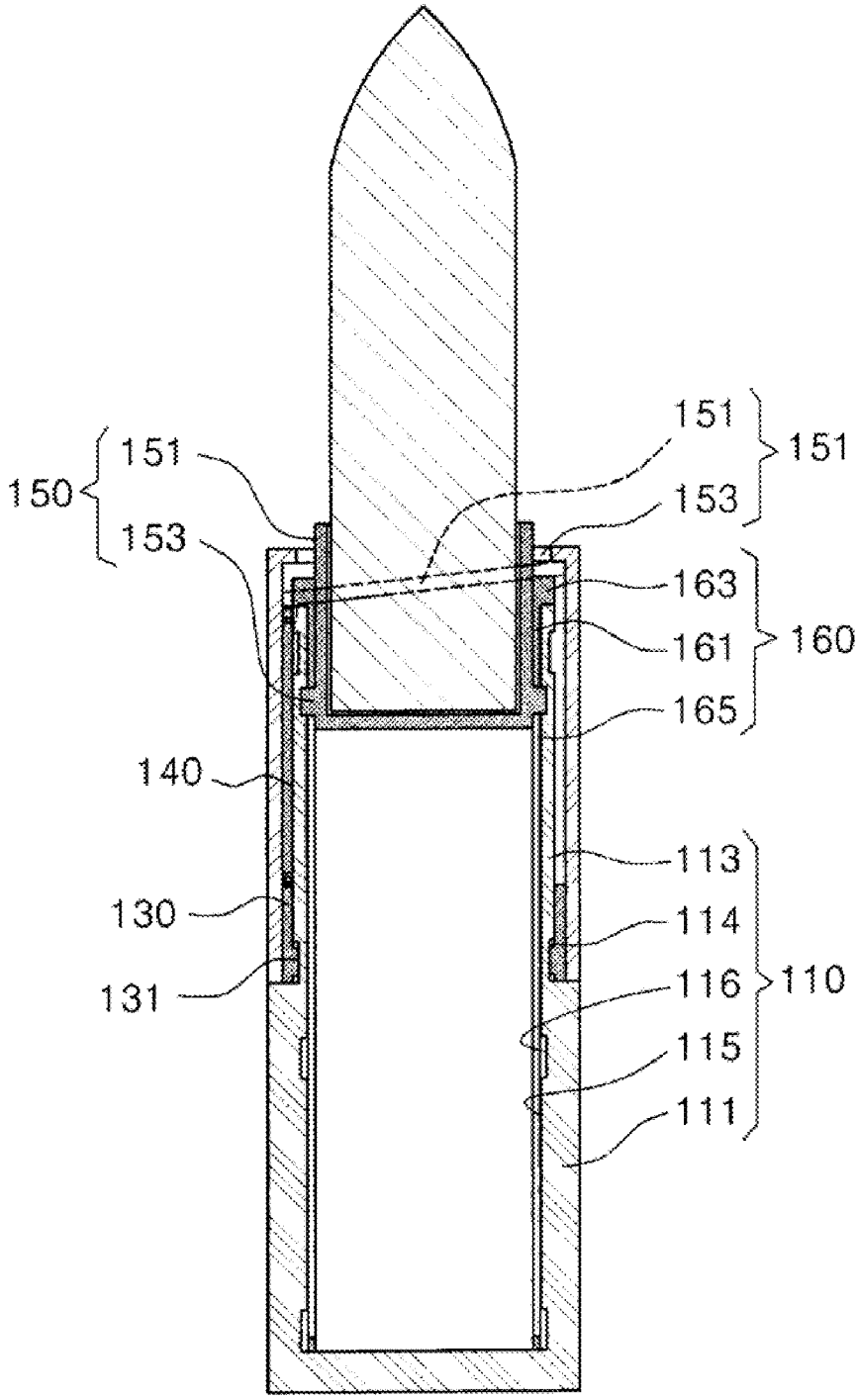
FIG. 5 is an assembly cross-sectional view of the one-hand lipstick container when it is being used, according to an embodiment of the present invention.

FIG. 1 is a perspective view of a one-hand lipstick container according to an embodiment of the present invention, FIG. 2 is an exploded perspective view of the one-hand lipstick container according to an embodiment of the present invention, FIG. 3 is an exploded cross-sectional view of the one-hand lipstick container according to an embodiment of the present invention, FIG. 4 is an assembly cross-sectional view of the one-hand lipstick container before it is used, according to an embodiment of the present invention, and FIG. 5 is an assembly cross-sectional view of the one-hand lipstick container when it is being used, according to an embodiment of the present invention.

As shown in FIGS. 1 to 5, a one-hand lipstick container according to an embodiment of the present invention includes a container main body 110, a container cover 120, a cover holder 130, a door 140, a lipstick housing 150, an anti-rotation means 160.

Hereafter, each part of the one-hand lipstick container of the present invention is described in detail.

First, the container main body 110 is described with reference to FIGS. 1 to 5.

In the container main body 110, a cylinder 113 is stood at the center of a body 111 and a center through-hole 115 is formed through the center of the cylinder 113.

The body 111 has a rectangular shape, but the shape is not limited thereto and can be variously changed into a circular shape or a polygonal shape.

Further, the cylinder 113, as shown in FIGS. 2 and 3, has an outer circumferential-spiral guide groove 114, in which the outer circumferential-spiral guide groove 114 guides the cover holder 130, which is combined by a spiral, to rotate upward/downward.

Further, the center through-hole 115 is connected to the bottom of the body 111 and has an inner circumferential-spiral guide groove 116, in which the inner circumferential-spiral guide groove 116 guides the lipstick housing 150 (described below) which is combined by a spiral, to rotate upward/downward.

In this configuration, the center through-hole 115 of the container main body 110 is an integral through-hole having the same inner diameter from the upper end of the cylinder 113 to the bottom of the body 111.

Next, the container cover 120 is described with reference to FIGS. 1 to 5.

The container cover 120 is rotatably connected to the upper portion of the container main body 110 and has an open inlet 121 formed through the upper surface.

The inlet 121 allows a lipstick received in the lipstick housing 150, which is combined with the container main body 110 and ascends/descends, to protrude outside, and as shown in FIGS. 2 and 3, the inlet 121 is opened or closed by the cover holder 130 and the door 140 that are disposed in the container cover 120 and ascends/descends.

A door guide groove 123 that guides the upper end opening/closing-path of the door 140 in accordance with the ascent/descent of the cover holder 130 is formed on the inner side of the container cover 120.

The container cover 120 has a rectangular shape, but the shape is not limited thereto and can be variously changed into a circular shape or a polygonal shape.

Next, the cover holder 130 is described with reference to FIGS. 2 to 5. The cover holder 130 is disposed in the container cover 120 and ascends/descends, in which the cover holder 130 and the container cover 120 are combined only to vertically slide, without rotating with respect to each other.

For this configuration, a rail may be formed to guide the sliding movement with respect to each other, but, as shown in FIGS. 2 and 3, it is possible to form the same inner shape (rectangular shape in the figures) while preventing rotation with respect to each other and allowing for free vertical movement.

Meanwhile, the cover holder 130 is combined by a spiral while covering the outer side of the cylinder 113 of the container main body 110, and for this, an outer circumference rotational-combination protrusion 131 that is fitted in the outer circumference spiral guide groove 114 formed on the cylinder 113 protrudes inward from the inner side of the cover holder 130.

As the container cover 120 rotates, the cover holder 130 is correspondingly rotated by the rotational force of the container cover 120, and also vertically ascends/descends along the outer circumference spiral guide groove 114, using the rotational force.

Next, the door 140 is described with reference to FIGS. 3 to 5.

The door 140 is combined with the cover holder 130 to open/close the upper portion and of which one end is hinged to a side of the cover holder 130 and the opposite end is fitted in the door guide groove 123 formed on the inner side of the container cover 120.

As the cover holder 130 descends, the end of the door 140 hinged to the cover holder 130 descends, and at the same time, the opposite end moves along the opening-path of the door guide groove 123, such that the inlet 121 of the container cover 120 is opened.

When the inlet 121 is fully opened, the door 140 is vertically stood and stops descending, which is the same as the last descent timing of the cover holder 130.

On the contrary, as the cover holder 130 ascends, the door 140 moves along the closing-path of the door guide groove 123, such that the inlet 121 of the container cover 120 is closed.

The ascent/descent of the cover holder 130 is performed by the rotational force of the container cover 120.

Figure 6:
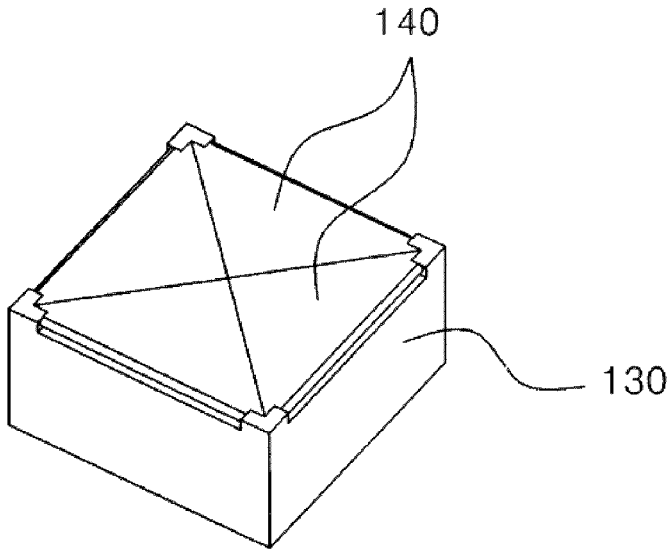
FIGS. 6 to 8 are perspective view showing a modified embodiment of the cover holder and the door of the present invention.
Figure 7:
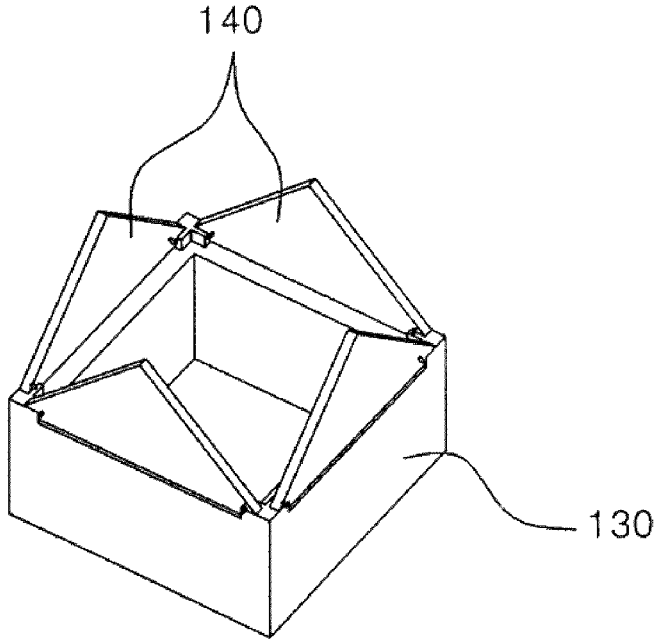
Figure 8:
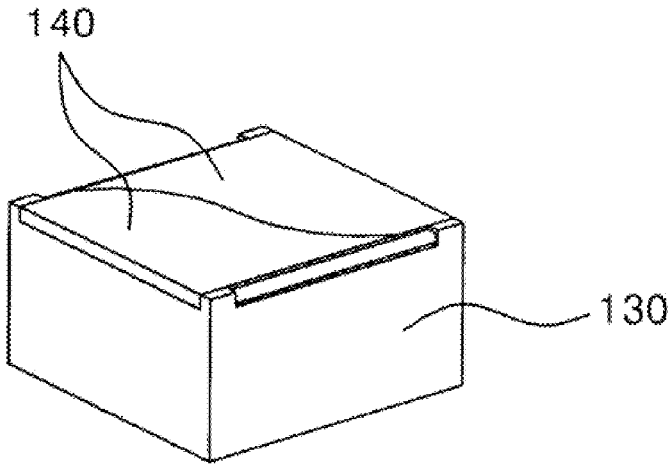

FIGS. 6 to 8 are perspective view showing a modified embodiment of the cover holder and the door of the present invention.

A door 140 of the present invention shown in the figures is separated into one or more sections and the separate doors 140 are connected to the sides of a cover holder 130, such that it is possible to simultaneously open or cover the inlet 121 of the container cover 120.

That is, as shown in FIGS. 6 and 7, it is possible to form the door 140 in a type of hinged door while simultaneously forming four doors separated diagonally.

Further, as shown in FIG. 8, it is also possible to form the door 140 in a type of hinged door with two separate half doors. In these configurations, the door 140 separated in a plurality of doors can be formed in various shapes by straight or curved boundary lines, or combinations of them (a Taegeuk pattern is shown in FIG. 8).

By separating the door 140 into a plurality of doors and operating it, as described above, the height of the door 140 is decreased, and accordingly, it is possible to reduce the movement distance for opening/closing of the door 140, such that it is possible to design a compact product.

Figure 9:
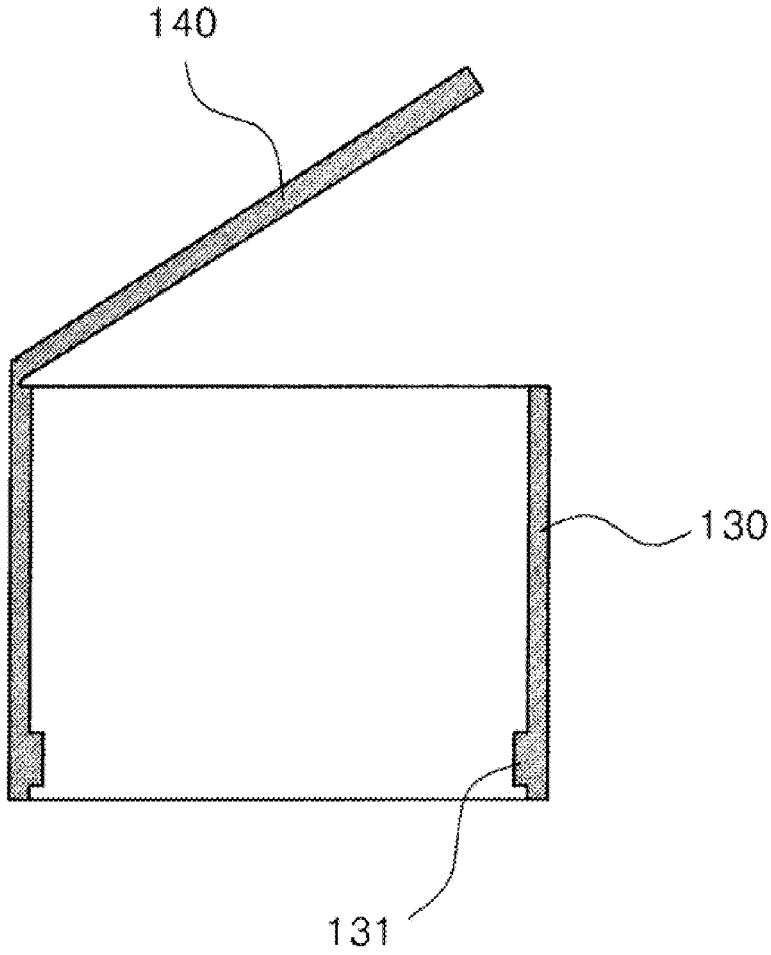
FIG. 9 is a cross-sectional view showing an example of a cover holder and a door integrally formed by injection molding according to the present invention.

FIG. 9 is a cross-sectional view showing an example of a cover holder and a door integrally formed by injection molding according to the present invention, and as shown in the figure, a cover holder 130 and a door 140 of the present invention can be integrally manufactured by injection-molding the connecting portion using soft or thin plastic, without using a hinge pin.

Further, it is possible to form the cover holder 130 and the door 140 by double injection molding, which can provide a peculiar appearance by changing the material or the color of the door 140 protruding outside. The double injection molding allows for making the colors of the doors different, when simultaneously forming a plurality of doors 140.

Further, as shown in FIG. 2, a protrusion having the same shape of that of the inlet 121 of the container cover 120 may be formed on the upper surface of the door 140, in which the protrusion may be formed on the same surface as the inlet 121 of the container cover 120 or may protrude upward further than the inlet 121.

Alternatively, it is possible to form a variety of patterns on the surface of the door 140 using raised or depressed patterns.

Figure 10:
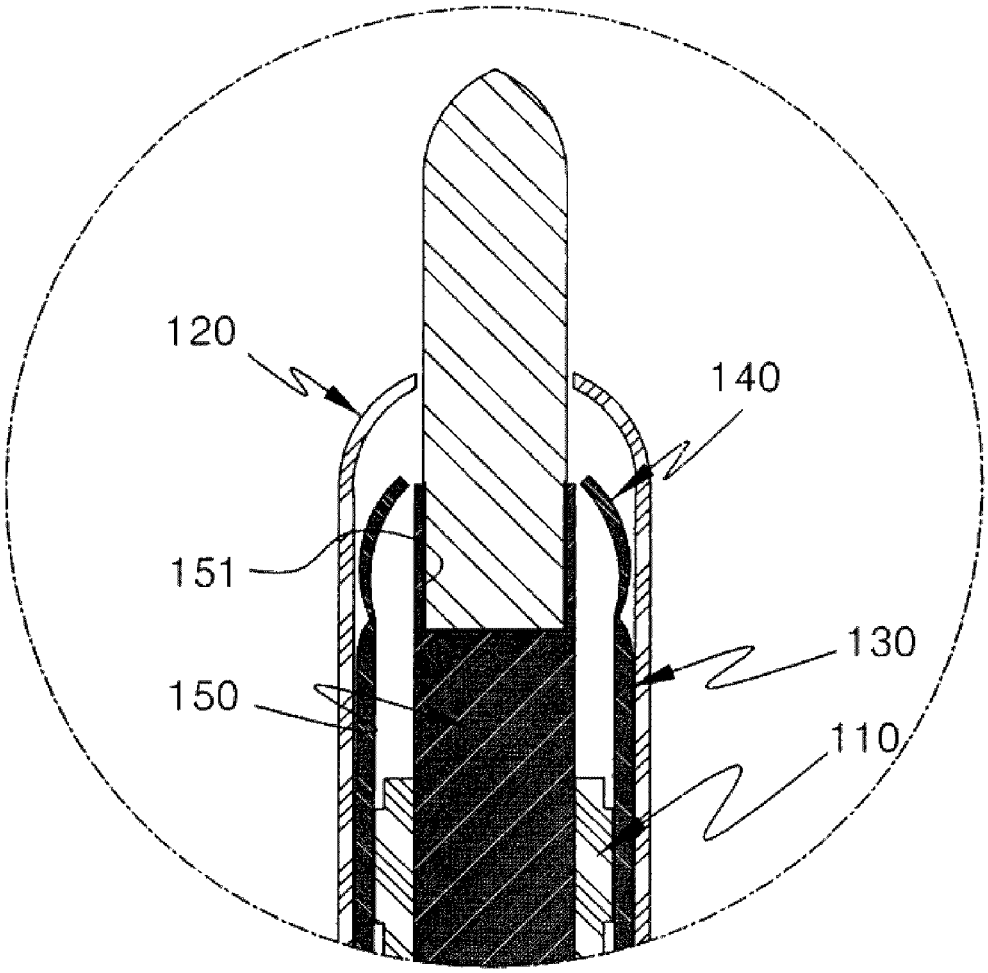
FIG. 10 is an assembly cross-sectional view showing an example of manufacturing the upper surfaces of the container cover and the door of the invention in dome shapes.

FIG. 10 is an assembly cross-sectional view showing an example of manufacturing the upper surfaces of the container cover and the door of the invention in dome shapes, and as shown in the figure, the upper surface of door 140 may be curved in a dome shape. In this configuration, it is possible to curve the upper surface of the container cover 120 to have a dome shape, which can emphasize a soft image of the product to users. In this example, the door 140 can be manufactured by both injection molding and hinge combination.

Next, the lipstick housing 150 is described in detail with reference to FIGS. 2 to 5.

The lipstick housing 150 is combined with the container main body 110 by the inner circumferential-spiral guide groove 116 formed on the center through-hole 115 of the container main body 110 to ascend/descend, and has a cylindrical housing body 151 where a lipstick is received and guide protrusions 153 that protrude on the outer side of the housing body 151 to be spirally fitted in the inner circumferential-spiral guide groove 116.

The lipstick housing 150 rotates with the cover holder 130 by the anti-rotation means 160 and vertically ascends/descends in accordance with the rotational direction.

In this configuration, it is important to form the spirals of the inner circumferential-spiral guide groove 116 and the outer circumferential-spiral guide groove 114 in the opposite directions.

This is for conversely operating the ascent/descent of the cover holder 130 and the ascent/descent of the lipstick housing 150.

That is, in a one-hand lipstick container of the present invention, as the cover holder 130 opens the door 140 while descending and the inlet 121 of the container cover 120 is opened, the lipstick housing 150 protrudes a lipstick outside through the inlet 121 of the container cover 120 while ascending.

Next, the anti-rotation means 160 is described in detail with reference to FIGS. 2 to 5.

The anti-rotation means 160 transmits the rotational force of the cover holder 130 to the lipstick housing 150 disposed in the center through-hole 115 and guides the lipstick housing 150 to ascend/descend in the opposite directions to the cover holder 130.

The anti-rotation means 160 is composed of a pipe body 161 that is disposed between the lipstick housing 150 and the center through-hole 115, a fixed end 163 that is connected to the cover holder 130 at the upper end of the pipe body 161, and slide grooves 165 that are vertically formed on the sides of the pipe body 161.

The fixed end 163 can be manufactured in a rectangular shape.

Meanwhile, the slide grooves 165 allows the guide protrusions 153 of the lipstick housing 150 to be spirally fitted in the inner circumference spiral guide groove 116 through it such that rotational force is transmitted to the lipstick housing 150 by the guide protrusions 153, when the anti-rotation means 160 is rotated by the rotational force of the cover holder 130.

The lipstick housing 150 is guided to ascend/descend along the inner circumferential-spiral guide groove 116 in the opposite direction to the cover holder 130 and vertically along the slide grooves 165 of the anti-rotation means 160.

Hereafter, the operation of a one-hand lipstick container according to an embodiment of the present invention is described with reference to FIGS. 4 and 5.

In FIG. 4, the inlet 121 of the container cover 120 is closed by the door 140 and the lipstick housing 150 has descended to the bottom of the container main body 110.

First, as shown in FIG. 4, a user rotates the container cover 120 with fingers, with the container body 110 in one hand.

In this operation, the cover holder 130 is rotated with the container main body 110 and the cover holder 130 descends while rotating along the outer circumferential-spiral guide groove 114 formed on the cylinder 113.

As shown in FIG. 5, as the cover holder 130 vertically descends along the inner side of the container cover 120, one end of the door 140 hinged to the cover holder 130 descends, and at the same time, the opposite end moves along the opening-path of the door guide groove 123, such that the inlet 121 of the container cover 120 is opened.

When the inlet 121 is fully opened, the door 140 is vertically stood and stops descending, which is the same as the last descent timing of the cover holder 130.

In this operation, the cover holder 130 descends, while the lipstick housing 150 ascends, in which since the lipstick housing 150 is rotated with the cover holder 130 by the anti-rotation means 160, they ascend/descend along the inner circumferential-spiral guide groove 116.

In this operation, the anti-rotation means 160 and the cover holder 130 cannot rotate with respect to each other, whereas they are combined to freely vertically slide.

That is, the cover holder 130 can transmit rotational force to the anti-rotation means 160 and descend.

The lipstick housing 150 that is received the rotational force from the anti-rotation means 160 ascends along the inner circumferential-spiral guide groove 116 in the opposite direction to the cover holder 130 and vertically along the slide grooves 165 of the anti-rotation means 160 such that the lipstick protrudes through the inlet 121 of the container cover 120.

The present invention described above is characterized in that the outer circumferential-spiral guide groove 114 spiraling opposite to the direction of the screw on the inner side of the container main body 110 is formed on the outer side of the cylinder 113.

This configuration is provide in order that when the lipstick housing 150 ascends along the inner circumferential-spiral guide groove 116, the cover holder 130 descends along the outer circumferential-spiral guide groove 114 of the cylinder 113, and at the same time, the door 140 is opened and the lipstick protrudes through the inlet 121 of the container cover 120.

Figure 11:
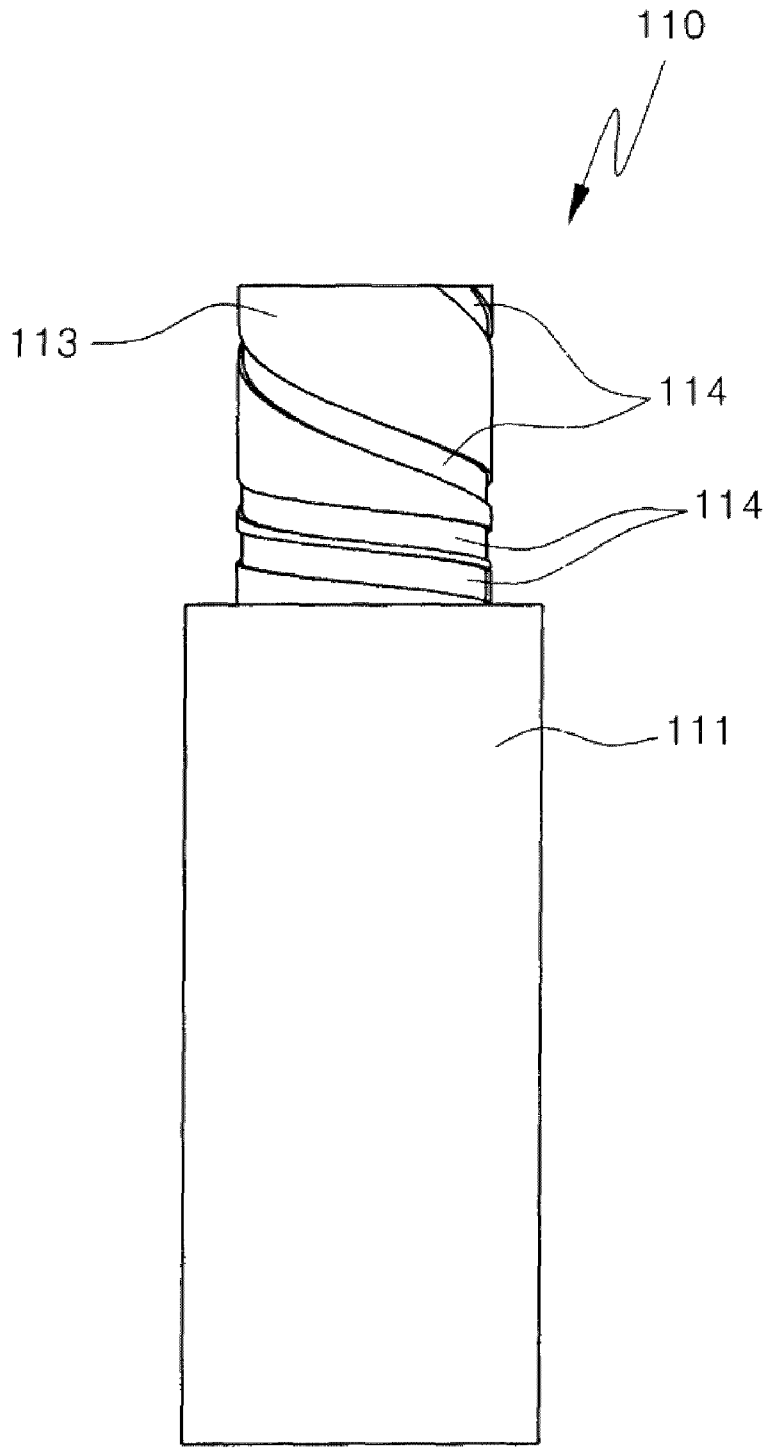
FIG. 11 is a front view showing an example of forming different pitches of an outer circumferential-spiral guide groove of the container main body of the present invention.

For this operation, in the present invention, it is possible to ununiformly form the pitch of the outer circumferential-spiral guide groove 114 on the outer side of the cylinder 113 of the container main body 110, as shown in FIG. 11, and for example, it is possible to make wide the pitch of the upper section in the entire section and relatively narrow the pitch of the lower section.

FIG. 11 is a front view showing an example of forming different pitches of an outer circumferential-spiral guide groove of the container main body of the present invention.

As shown in the figure, the reason that the pitch of the outer circumferential-spiral guide groove 114 is ununiform is because the descent section of the cover holder 130 is relatively shorter than the ascent section of the lipstick housing 150. Further, the ununiform pitch is provided in order to first open the inlet 121 of the container cover 120 by rapidly moving down cover holder 130 in the upper section of the outer circumferential-spiral guide groove 114, and then maintain the rotation while the lipstick housing 150 ascends to the highest level by reducing the pitch gap such that the cover holder 130 descends slow in the lower section.

Further, according to the present invention, in contrast to the above description, it is also possible to ununiformly form the pitch of the inner circumferential-spiral guide groove 116, in which the pitch is set small at the lower section such that the lipstick housing ascends slow while waiting for the opening timing of the door 140, and the pitch is set large after the door 140 is opened such that it can rapidly ascend.

Further, though not shown in the figures of the present invention, it is possible to taper the lower portion or the upper portion of the outer circumferential-spiral guide groove 114, instead of ununiformly forming the pitch of the outer circumferential-spiral guide groove 114.

As described above, when the lower portion or the upper portion of the outer circumferential-spiral guide groove 114 is tapered, when the cover holder 130 is locked and cannot further rotate in rotating in any one direction of the left and right, the guide protrusions spirally fitted in the outer circumferential-spiral guide groove 114 are separated from the outer circumferential-spiral guide groove 114 in the tapered direction and slip on the outer surface of the cylinder 113.

That is, a kind of idling condition is provided such that the cover holder 130 idles until the lipstick housing 150 reaches the highest position.

In this configuration, when the cover holder 130 is reversely rotated, the guide protrusions are inserted in the outer circumferential-spiral guide groove 114, and then are guided to the opposite side, which is not tapered, and ascend or descend.

Further, it is also possible to make the cover holder 130 idle until the lipstick housing 150 reaches the maximum descent position, by separating the guide protrusions from the outer circumferential-spiral guide groove 114 in the rotational direction when the cover holder 130 reaches the maximum ascent position.

Hereafter, a one-had lipstick container according to another embodiment of the present invention is provided with reference to FIGS. 12 to 16.

Figure 12:
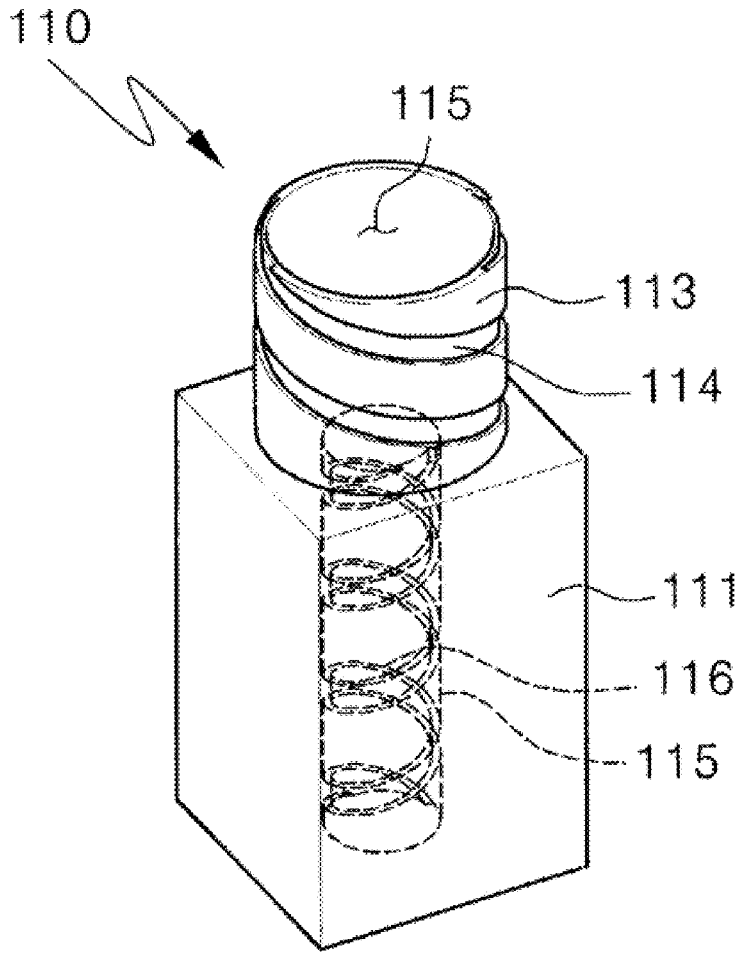
FIG. 12 is a perspective view showing the structure of a one-hand lipstick container according to another embodiment of the present invention.

FIG. 12 is a perspective view showing the structure of a one-hand lipstick container according to another embodiment of the present invention, and as shown in the figure, in the one-hand lipstick container according to another embodiment of the present invention, a center through-hole 115 of a container main body 110 is formed of a two-coupled center through-hole 115 composed of a portion having a large inner diameter at a cylinder 113 and a portion having a small inner diameter at the body 111. Further, an inner circumferential-spiral guide groove 116 is formed on the inner side of the lower portion of the center through-hole 115 in the body 111.

Figure 13:
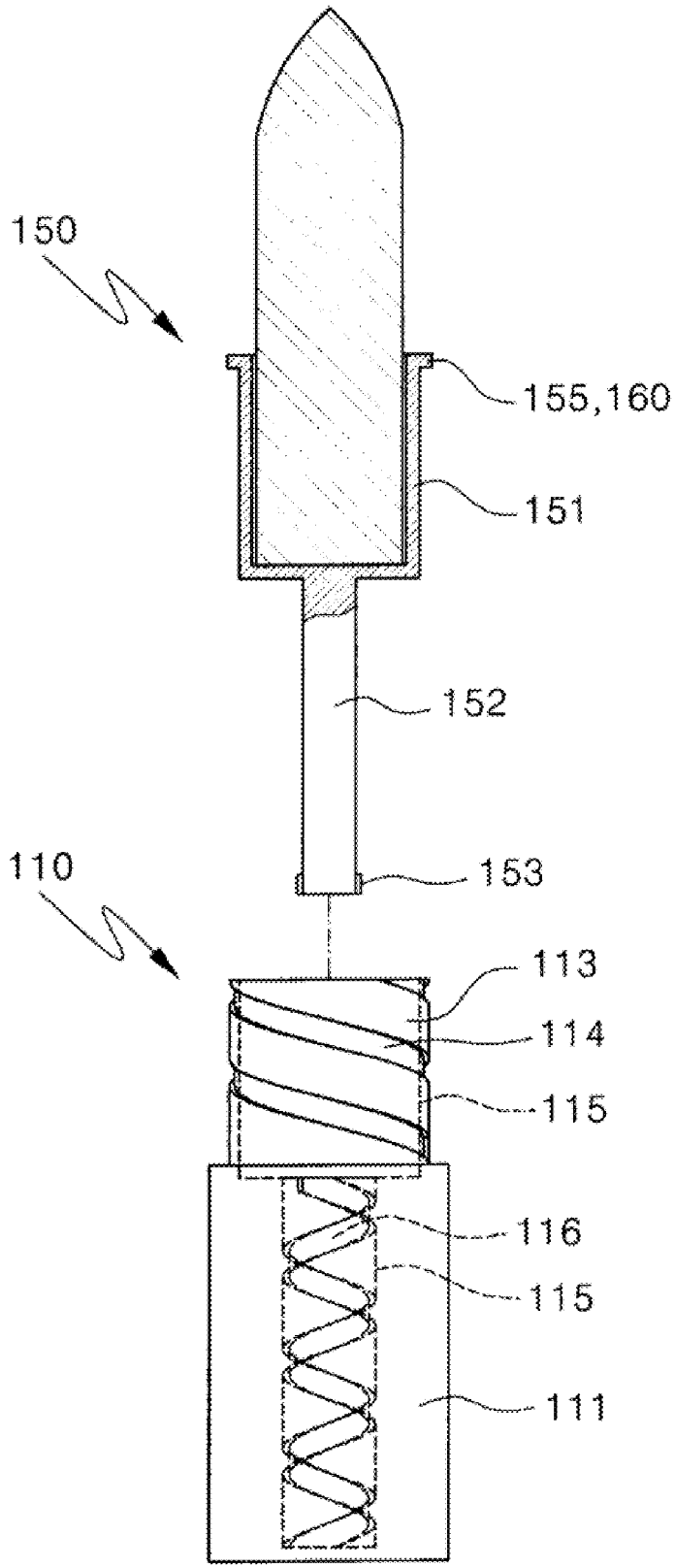
FIG. 13 is an exploded view showing when a container main body is combined with a lipstick housing according to another embodiment of the present invention

FIG. 13 is an exploded view showing when the container main body is combined with a lipstick housing according to another embodiment of the present invention, and as shown in this figure, the lipstick housing 150 ascends/descends with a lipstick therein is disposed in the center through-hole 150.

In this configuration, the lipstick housing 150 has a cylindrical housing body 151 that is inserted in the upper portion of the center through-hole 115 of the cylinder 113 and a slide column 152 that extends down from the housing body 151 and is inserted in the lower portion of the center through-hole 115 in the body 111, and a guide protrusion 153 that is fitted in an inner circumferential-spiral guide groove 116 protrudes around the end of the slide column 152.

The configuration of the container cover 120, the cover holder 130, and the door 140 of the lipstick container according to the embodiment of the present invention shown in FIGS. 1 to 11 can be applied in the same way to the lipstick container according to another embodiment of the present invention, shown in FIGS. 12 and 13.

Accordingly, the description for the configuration and operation of them is not provided, and the configuration and relationship of the container main body 110, the lipstick housing 150, the cover holder 130, and the anti-rotation means 160 are described in detail.

Another embodiment of the present invention described above can be changed in various ways in accordance with the configuration of the anti-rotation means 160.

The anti-rotation means 160 transmits the rotational force of the cover holder 130 to the lipstick housing 150 disposed in the center through-hole 115 of the container main body 110 and guides the lipstick housing 150 to ascend/descend in the opposite directions to the cover holder 130.

First, as shown in FIG. 13, it is possible to form the anti-rotation means 160 around the upper end of the lipstick housing 150, and the anti-rotation means 160 can be formed by horizontally extending a protrusion or the edge around the upper end of the lipstick housing 150.

Figure 14:
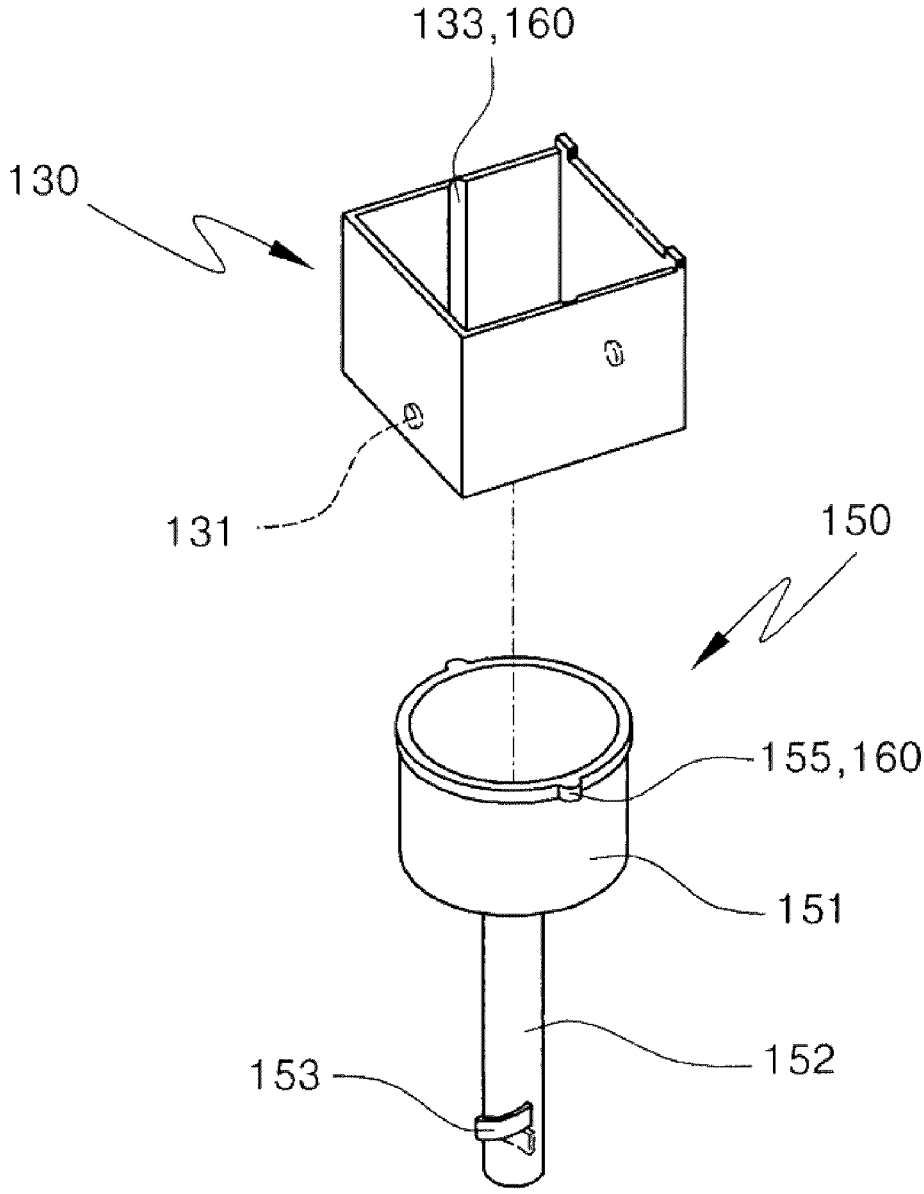
FIG. 14 is an exploded perspective view showing an example of forming a slide protrusion at the upper end of the lipstick housing and a protrusion guide groove, which is fitted on the slide protrusion, on the inner side of the cover holder to prevent rotation, according to another embodiment of the present invention.

FIG. 14 is an exploded perspective view showing an example of forming a slide protrusion at the upper end of the lipstick housing and a protrusion guide groove, which is fitted on the slide protrusion, on the inner side of the cover holder to prevent rotation, according to another embodiment of the present invention.

As shown in the figure, the anti-rotation means 160 can be implemented by forming side protrusions 155 protruding from the edge of the upper end of a pipe body 161 of the lipstick housing 150 and protrusion guide grooves 133, in which the slide protrusions 155 are fitted, on the inner side of the cover holder 130, and then fitting the slide protrusions 155 in the protrusion guide grooves 133.

Figure 15:
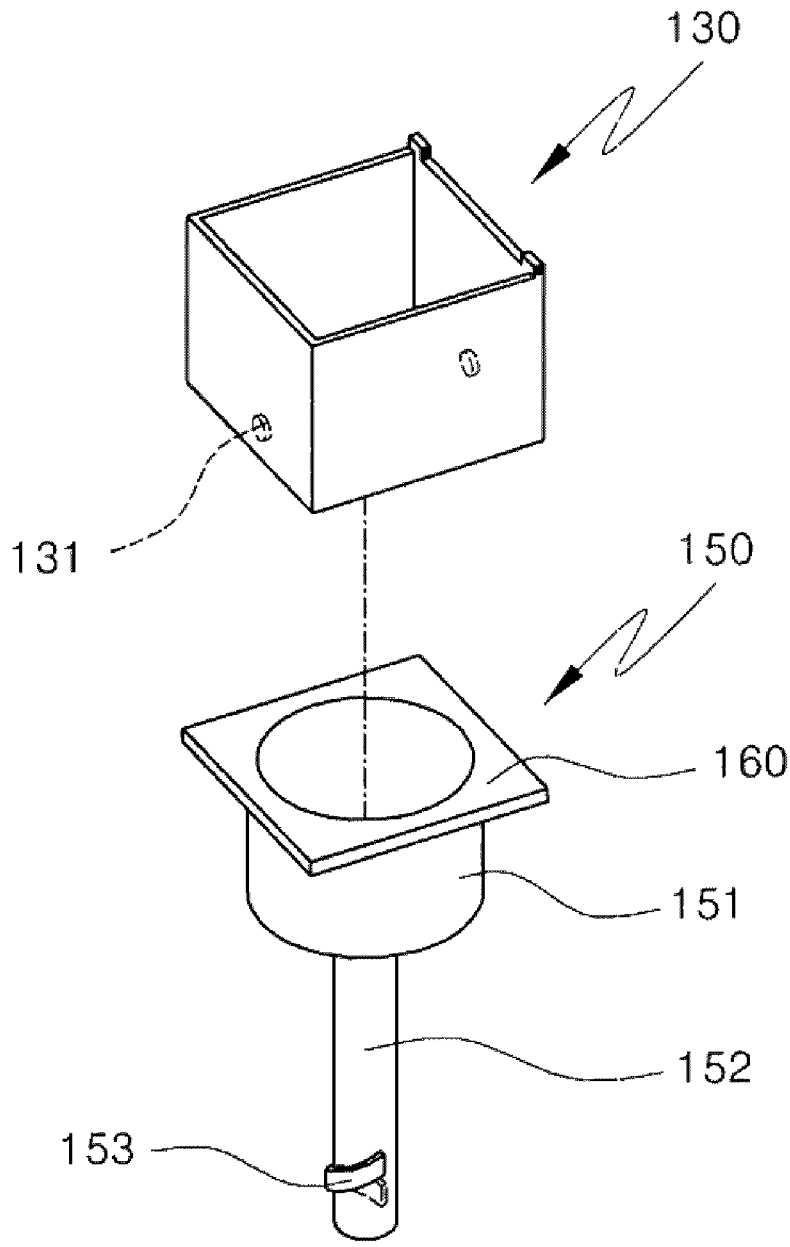
FIG. 15 is an exploded perspective view showing an example of forming a rectangular edge at the upper end of the lipstick housing to prevent rotation when being combined with the cover holder.

FIG. 15 is an exploded perspective view showing an example of forming a rectangular edge at the upper end of the lipstick housing to prevent rotation when being combined with the cover holder.

As shown in the figure, the anti-rotation means 160 can have a configuration in which a rectangular plate-shaped edge part is formed around the upper end of the pipe body 161 of the lipstick housing 150 and the edge part is fitted inside the cover holder 130 to prevent rotation.

Figure 16:
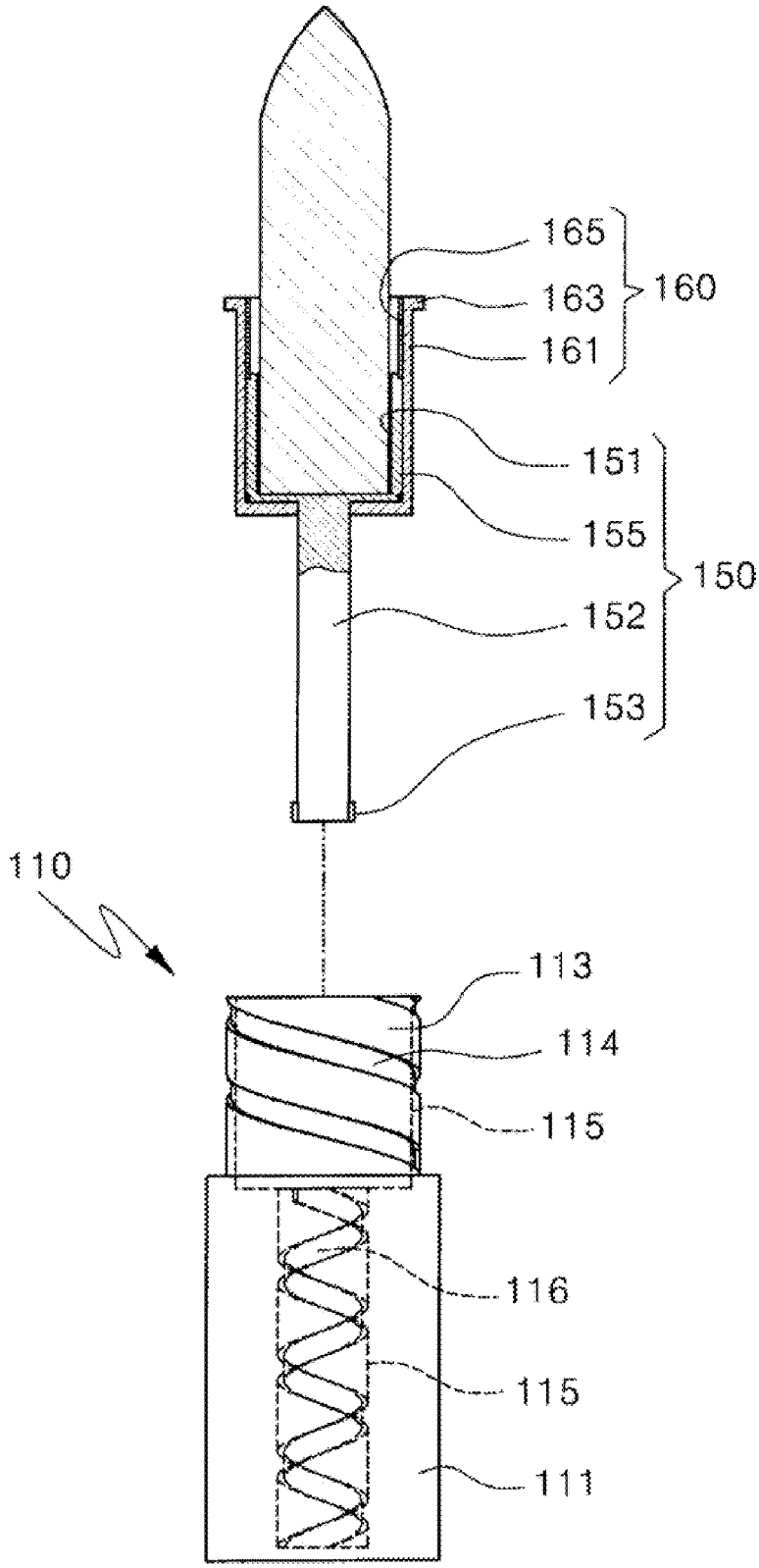
FIG. 16 is a cross-sectional view showing an example when the lipstick housing is inserted in the anti-rotation means according to the present invention.

FIG. 16 is a cross-sectional view showing an example when the lipstick housing is inserted in the anti-rotation means according to the present invention.

As shown in the figure, the anti-rotation means 160 is formed of a pipe body 161 that is inserted in the center through-hole 115, a fixed end 163 that is fitted inside the cover holder 130 and receives rotational force is formed at the upper end of the pipe body 161, and slide grooves 165 are vertically formed on the inner side of the pipe body 161.

In this configuration, the lipstick housing 150 is received in the pipe body 161 and rail-shaped slide protrusions 155 that are fitted in the slide grooves 165 are formed on the sides of the housing body 151 of the lipstick housing 150.

The slide column 152 of the lipstick housing 150 passes through the bottom of the pipe body 161, and as shown in FIG. 13, the slide column 152 is spirally fitted in the inner circumferential-spiral guide groove 116 at the lower portion.

In this configuration, a guide protrusion 153 for spiral fitting is formed at the lower end of the slide column 152.

Figure 17:
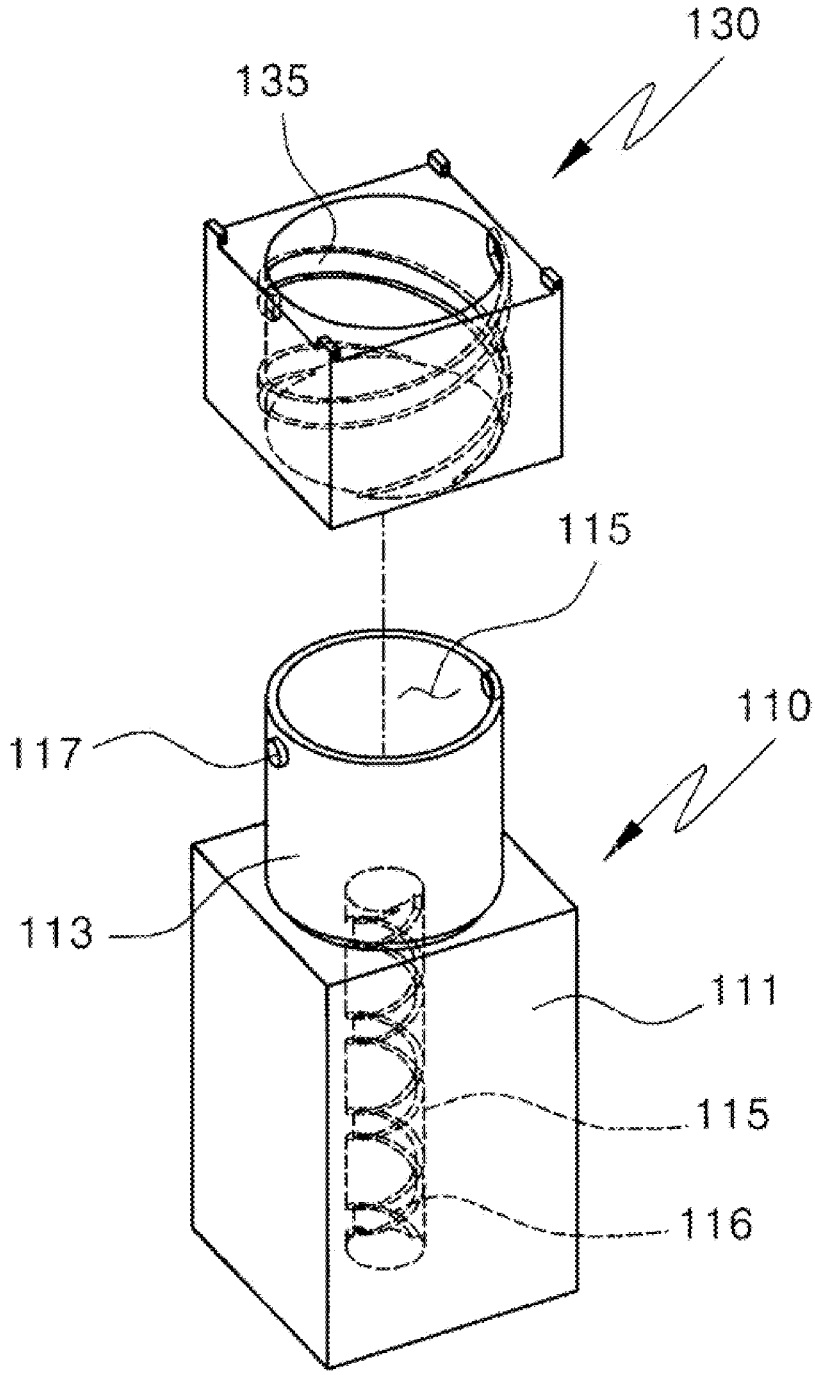
FIG. 17 is an exploded perspective view showing an example of forming screw protrusions on the outer side of the container main body and a screw guide groove on the inner side of the cover holder.

FIG. 17 is an exploded perspective view showing an example of forming screw protrusions on the outer side of the container main body and a screw guide groove on the inner side of the cover holder.

According to the present invention shown in the figure, holder inner circumferential protrusions 117 are formed on the outer side of the cylinder 113 of the container main body 110 and a holder inner circumferential guide groove 135 in which the holder inner circumferential screw protrusions 117 are spirally fitted is formed on the inner side of the cover holder 130.

This combination structure can be applied to the embodiments of the present invention shown in FIGS. 1 to 16 or other embodiments.

The present invention described above provides convenience for users and makes it possible to use the lipstick container with one hand by forming the container main body 110 and the container cover 120 at a similar height or forming the container main body 110 at a slightly large height.

That is, according to the present invention, a user can easily grip the container main body 110 with the palm, and in this position, the user can easily make up by rotating the container cover 120 with the thumb etc. to protrude the lipstick housing 150 and the lipstick.

Figure 18:
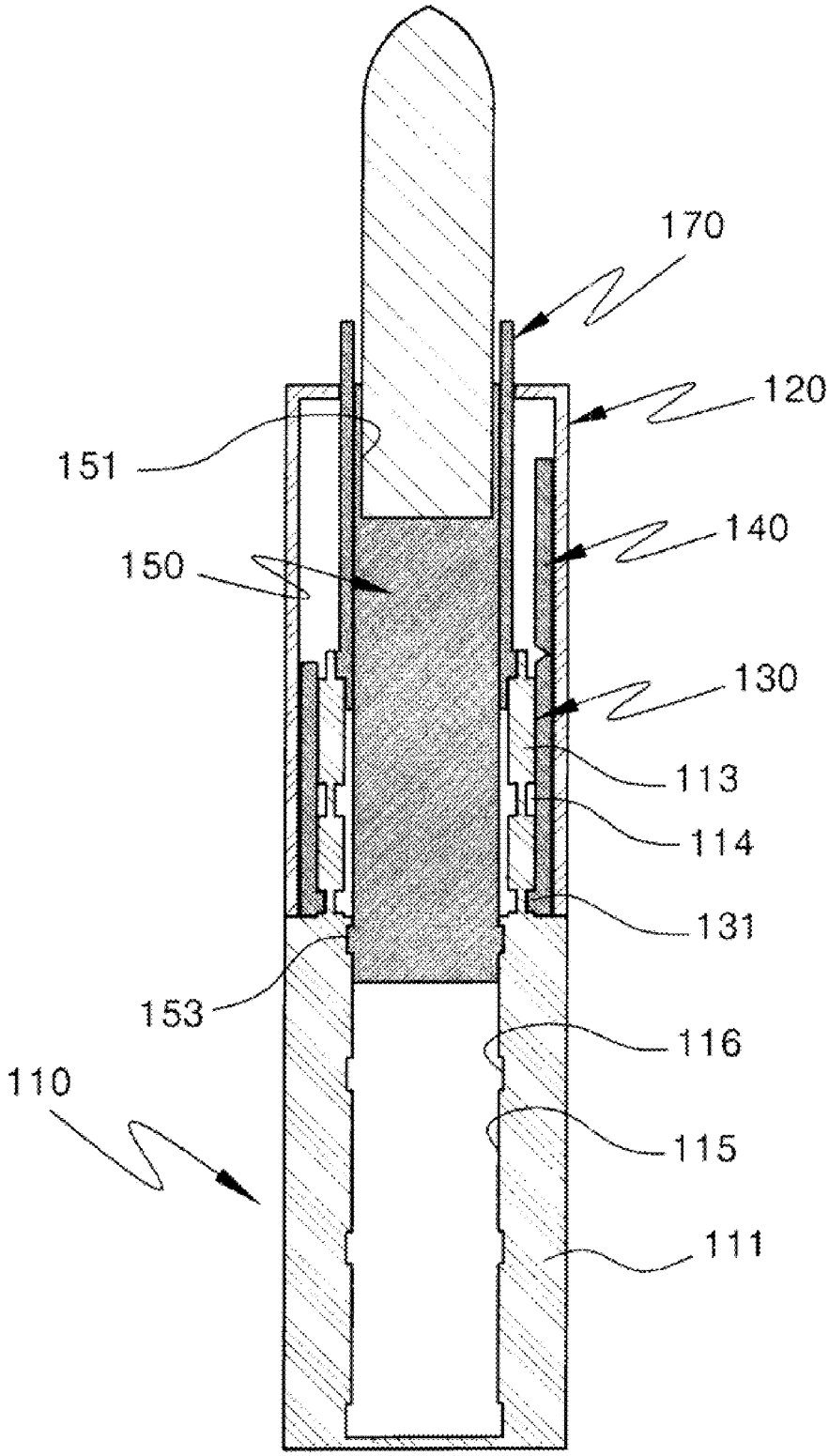
FIG. 18 is an assembly cross-sectional view showing an example of disposing a cylinder member between the container main body and the lipstick housing.
Figure 19A:
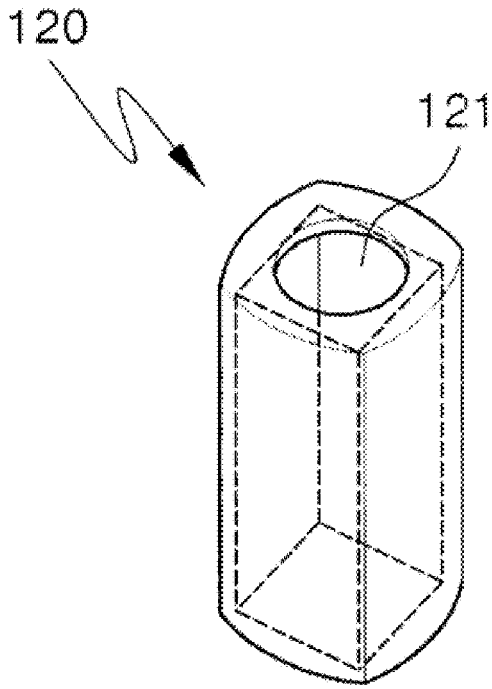
FIGS. 19A to 19D are perspective views showing modified embodiments of the container cover of a one-hand lipstick container according to the present invention.
Figure 19B:
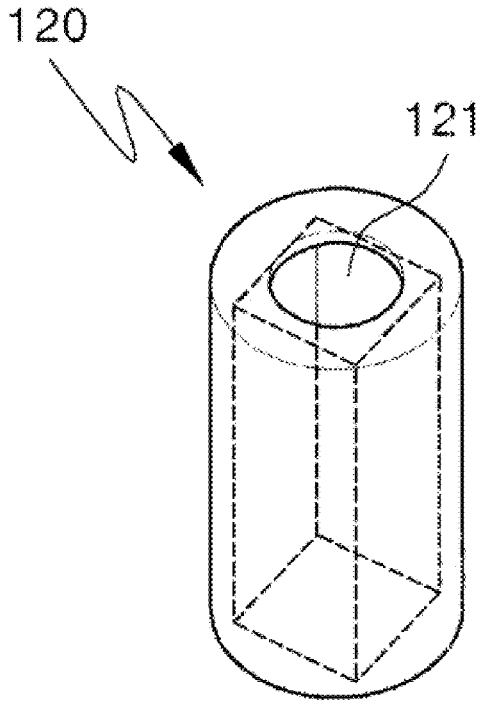
Figure 19C:
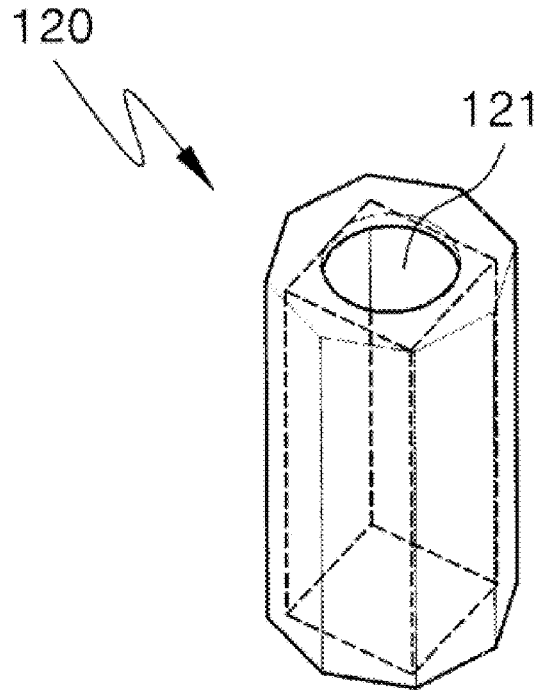
Figure 19D:
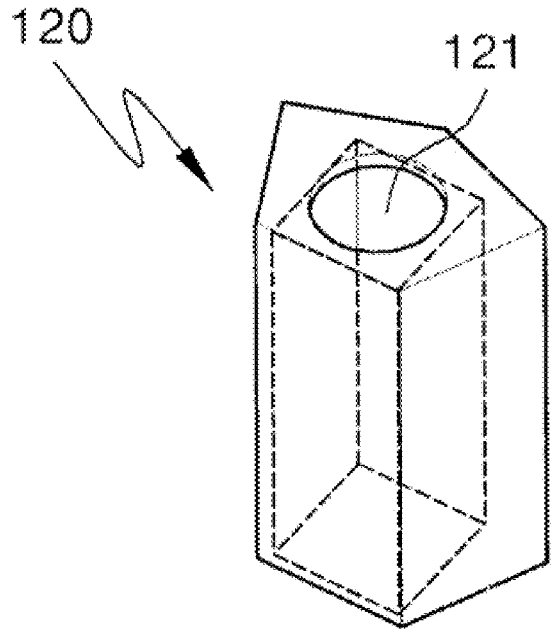

FIG. 18 is an assembly cross-sectional view showing an example of disposing a cylinder member between the container main body and the lipstick housing.

The lipstick container according to the present invention shown in the figure can be configured such that a spiral guide groove is formed on the inner side of the upper portion of the center through-hole 115, a cylinder member 170 that ascends/descends along the spiral guide groove is disposed between the container main body and the lipstick housing 150, and the lipstick housing 150 that vertically ascends/descends is disposed inside the cylinder member 170.

In this configuration, the cylinder member 170 is formed in a pipe shape and ascends first to the uppermost portion of the center through-hole 115 to protrude through the inlet 121 of the container cover 120 before the lipstick housing 150 ascends, and then the lipstick housing 150 ascends second over the cylinder member 170 such that the lipstick protrudes.

This is for preventing a problem that the door 140 interferes with the lipstick.

Further, according to the present invention described above, it is possible to form a spiral guide groove (not shown) on the inner side of the upper portion of the center through-hole 115 of the container main body 110 such that the cover holder 130 ascends/descends while being spirally fitted in the spiral guide groove. Accordingly, the cover holder 130 moves inside the center through-hole 115, such that it is possible to lower the lowermost position and the uppermost position in the movement section, and accordingly, it is possible to maximally use the upper space of the container cover 120.

FIGS. 19A to 19D are perspective views showing modified embodiments of the container cover of a one-hand lipstick container according to the present invention, and in the figures, although only the shape of the container cover 120 is shown, the shape of the container main body 110 is also applied.

It is possible to form the outer shape of the container cover 120 using N straight or curved surfaces. The N is a number from 3 to the infinity and the shape corresponding to the infinity may be a circle. Further, it is preferable to form the inside of the container main body 110 and the container cover 120 in a rectangular shape.

Further, it is possible to form the inlet 121 at the upper portion of the container cover 120 in a different shape from the cross-sectional shape of the lipstick. That is, when the cross section of the lipstick is a circle, the inlet 121 can be manufactured in a polygonal shape etc.

Although it is possible to manufacture the container main body 110 and the container cover 120 of the lipstick container of the present invention described above with synthetic resin, metal, or ceramic, when they are made of metal, such as aluminum, it is possible to improve the quality of a product due to the peculiar luster and the feel of metal.

In particular, using metal can decrease the thickness of a product, such that it is possible to decrease the entire size of the product, which contributes to refine the image of the product.

The present invention having the configurations described above makes it possible to use the lipstick container with one hand, such that the use is simple and a good appearance is provided.

Further, since all the parts are assembled in the container cover and the container main body and the parts are not exposed to the outside, elegant design can be accomplished even if the lipstick container is manufactured to have the same external appearance as existing lipstick containers. In addition, since the lipstick container is used by rotating the container main body, similar to existing lipstick containers, users can familiarly use it, without strangeness.

Further, according to the present invention, by optimizing the height of the container main body such that a user can take all action with the lipstick container in one hand, it is possible to easily rotate the container cover with fingers while gripping the container main body with the palm, such that the use is convenient.

What is claimed is:

1. A one-hand lipstick container comprising:

a container main body (110) having a cylinder (113) stood at the center of a body (111) and a center through-hole (115) formed through the center of the cylinder (113);

a container cover (120) that is rotatably connected to the upper portion of the container main body (110) and has an open inlet (121) formed through the upper surface;

a cover holder (130) that is combined by a spiral with the outer side of the cylinder (113) of the container main body (110) in the container cover (120) and vertically ascends/descends by rotational force of the container cover (120);

a door (140) that is hinged to the cover holder (130) to open/close the upper portion of the cover holder (130), opens a passage when the cover holder (130) descends, and closes the passage when the cover holder (130) ascends;

a lipstick housing (150) that is combined by a spiral with the inner side of the center through-hole (115) of the container main body (110) in the cover holder (130), vertically ascends/descends by rotational force of the cover holder (130), and ascends/descends in the opposite directions to the ascent/descent directions of the cover holder (130); and an anti-rotation means (160) that transmits the rotational force of the cover holder (130) to the lipstick housing (150) and vertically guides the lipstick housing (150) to ascend/descend in the opposite directions to the ascent/descent directions of the cover holder (130).

2. The one-hand lipstick container according to claim 1, wherein the center through-hole (115) of the container main body (110) is formed of an integral through-hole having the same inner diameter at the cylinder (113) and at the body (111), and an inner circumferential-spiral guide groove (116) is formed on the inner side of the center through-hole (115).

3. The one-hand lipstick container according to claim 2, wherein the lipstick housing (150) ascending/descending with a lipstick is disposed in the center through-hole (115), and the lipstick housing (150) has a cylindrical housing body (151) and guide protrusions (153) that are fitted in the inner circumferential-spiral guide groove (116) are formed on the sides of the housing body (151).

4. The one-hand lipstick container according to claim 3, wherein the anti-rotation means (160) that prevents the lipstick housing (150) from rotating with the center through-hole (115) and allows the lipstick housing (150) to rotate with the container cover (120) is disposed between the lipstick housing (150) and the center through-hole (115), and the anti-rotation means (160) is formed of a pipe body (161) and has a fixed end (163) that is formed at the upper end of the pipe body (161) and fitted in the cover holder (130) to receive rotational force, and slide grooves (165) that are vertically formed on the sides of the pipe body (161) such that the guide protrusions (153) formed on the lipstick housing (150) are vertically guided through the slide grooves (165).

5. The one-hand lipstick container according to claim 2, wherein a spiral guide groove is formed on the inner side of the upper portion of the center through-hole (115), a cylinder member (170) that ascends/descends along the spiral guide groove is disposed between the container main body and the lipstick housing (150), the lipstick housing (150) that vertically ascends/descends is disposed inside the cylinder member (170), in which the cylinder member (170) ascends first to the uppermost portion of the center through-hole (115) to protrude through the inlet (121) of the container cover (120), and then the lipstick housing (150) ascends second over the cylinder member (170) such that the lipstick protrudes.

6. The one-hand lipstick container according to claim 1, wherein the center through-hole (115) of the container main body (110) is formed of a two-coupled through-hole (115) at the upper and lower portions, which has a large inner diameter at the cylinder (113) and a small inner diameter at the body (111), the inner circumferential-spiral guide groove (116) is formed on the inner side of the lower portion of the center through-hole (115) of the body (111).

7. The one-hand lipstick container according to claim 6, wherein the lipstick housing (150) ascending/descending with a lipstick is disposed in the center through-hole (115), and the lipstick housing (150) has the cylindrical housing body (151) that is inserted in the upper portion of the center through-hole (115) corresponding to the cylinder (113), a slide column (152) that extends from the bottom of the housing body (151) and is fitted in the lower portion of the center through-hole (115) corresponding to the body (111), and guide protrusions (153) that are formed around the edge of the end of the slide column (152) and are fitted in the inner circumferential-spiral guide groove (116).

8. The one-hand lipstick container according to claim 7, wherein the anti-rotation means (160) that prevents the lipstick housing (150) from rotating with the center through-hole (115) and allows the lipstick housing (150) to rotate with the container cover (120) is disposed around the upper end of the lipstick housing (150).

9. The one-hand lipstick container according to claim 7, wherein the anti-rotation means (160) includes side protrusions (155) protruding from the edge of the upper end of the pipe body (161) of the lipstick housing (150) and protrusion guide grooves, in which the slide protrusions (155) are fitted and vertically guided, formed on the inner side of the cover holder (130).

10. The one-hand lipstick container according to claim 6, wherein a spiral guide groove is formed on the inner side of the upper portion of the center through-hole (115) of the container main body (110) and the cover holder (130) is combined by a spiral with the spiral guide groove to ascend/descend.

11. The one-hand lipstick container according to claim 6, wherein a spiral guide groove is formed on the inner side of the upper portion of the center through-hole (115), a cylinder member (170) that ascends/descends along the spiral guide groove is disposed between the container main body and the lipstick housing (150), the lipstick housing (150) that vertically ascends/descends is disposed inside the cylinder member (170), in which the cylinder member (170) ascends first to the uppermost portion of the center through-hole (115) to protrude through the inlet (121) of the container cover (120), and then the lipstick housing (150) ascends second over the cylinder member (170) such that the lipstick protrudes.

12. The one-hand lipstick container according to claim 1, wherein the anti-rotation means (160) allows the lipstick housing (150) to vertically move and prevent the lipstick housing (150) from slipping in the rotational direction by having a surface contacting with the inner side of the cover holder (130) on the upper surface of the lipstick housing (150), or a protrusion fitted in the cover holder (130).

13. The one-hand lipstick container according to according to claim 1, wherein the outer circumferential-spiral guide groove (114) spiraling opposite to the direction of the screw on the inner side of the container main body (110) is formed on the outer side of the cylinder (113).

14. The one-hand lipstick container according to according to claim 1, wherein the pitch of an outer circumferential-spiral guide groove (114) formed on the outer side of the cylinder (113) of the container main body (110) is not uniform.

15. The one-hand lipstick container according to according to claim 1, wherein the cover holder (130) and the door (140) are connected by soft or thin plastic.

16. The one-hand lipstick container according to according to claim 1, wherein the cover holder (130) and the door (140) are formed by double injection molding.

17. The one-hand lipstick container according to according to claim 1, wherein a protrusion having the same shape as the shape of the inlet (121) of the container cover (120) is formed on the upper surface of the door (140).

18. The one-hand lipstick container according to according to claim 1, wherein a door (140) is separated into one or more sections and the separate doors (140) are connected to the sides of a cover holder (130) to simultaneously open or cover the inlet (121) of the container cover (120).

19. The one-hand lipstick container according to according to claim 1, wherein an outer circumference rotational-combination protrusion (131) is formed on the outer side of the cylinder (113) of the container main body (110) and a spiral guide groove in which the guide protrusions are spirally fitted is formed on the inner side of the cover holder (130).

20. The one-hand lipstick container according to according to claim 1, wherein the height of the container main body (110) and the container cover (120) is about the same or the height of the container main body (110) is slightly larger.

21. The one-hand lipstick container according to according to claim 1, wherein the outer shape of the container main body (110) and the container cover (120) is formed by N straight or curved surfaces, N is a number from 3 to the infinity, and the shape corresponding to the infinity is a circle.

22. The one-hand lipstick container according to according to claim 1, wherein a door guide groove (123) that guides the upper end of the door (140) when the door (140) is opened is formed on the inner side of the container cover (120).

23. The one-hand lipstick container according to according to claim 1, wherein the shape of the inlet (121) at the upper portion of the container cover (120) is different from the cross-sectional shape of the lipstick.

24. The one-hand lipstick container according to according to claim 1, wherein the upper surface of the door (140) is curved.

25. The one-hand lipstick container according to according to claim 1, wherein the container main body (110) and the container cover (120) are made of synthetic resin, metal, or ceramic.

26. The one-hand lipstick container according to according to claim 1, wherein the lower portion or the upper portion of the outer circumferential-spiral guide groove (114) is tapered, when the cover holder (130) is locked and cannot further rotate in rotating in any one direction of the left and right, the guide protrusions spirally fitted in the outer circumferential-spiral guide groove (114) are separated from the outer circumferential-spiral guide groove (114) in the tapered direction and slip on the outer surface of the cylinder (113).

* * * * *